US006921194B2

(12) United States Patent
Weber

(10) Patent No.: US 6,921,194 B2
(45) Date of Patent: Jul. 26, 2005

(54) DEVICE FOR MIXING A FLOWABLE OR POURABLE MEDIUM, ESPECIALLY A HIGHLY VISCOUS MEDIUM

(75) Inventor: Hans Weber, Waldshut-Tiengen (DE)

(73) Assignee: INOTEC GmbH Transport- und Fordersysteme, Waldshut-Tiengen (DE)

( * ) Notice: Subject to any disclaimer, the term of this patent is extended or adjusted under 35 U.S.C. 154(b) by 192 days.

(21) Appl. No.: 10/432,046

(22) PCT Filed: Nov. 15, 2001

(86) PCT No.: PCT/DE01/04304

§ 371 (c)(1),
(2), (4) Date: May 19, 2003

(87) PCT Pub. No.: WO02/41982

PCT Pub. Date: May 30, 2002

(65) Prior Publication Data

US 2004/0037163 A1 Feb. 26, 2004

(30) Foreign Application Priority Data

Nov. 23, 2000 (DE) ..... 200 19 941 U

(51) Int. Cl.[7] ..... B01F 7/20

(52) U.S. Cl. ..... 366/325.6; 366/325.1; 416/91; 416/227 R

(58) Field of Search ..... 366/129, 325.1, 366/325.6, 326.1; 416/76, 91, 227 R, 231 A, 240

(56) References Cited

U.S. PATENT DOCUMENTS

| | | | | | |
|---|---|---|---|---|---|
| 64,928 | A | * | 5/1867 | Williams | 416/173 |
| 119,193 | A | * | 9/1871 | Smith et al. | 366/328.2 |
| 122,075 | A | * | 12/1871 | Still | 416/91 |
| 195,019 | A | * | 9/1877 | Jones | 416/227 R |
| 424,108 | A | * | 3/1890 | Hallam | 366/325.6 |
| 781,917 | A | * | 2/1905 | Smith | 416/70 R |
| 1,208,862 | A | * | 12/1916 | Velissarides | 416/66 |
| 1,223,839 | A | * | 4/1917 | Turner | 416/76 |
| 1,779,181 | A | | 10/1930 | McDonald | |
| 5,037,210 | A | * | 8/1991 | Bliss | 366/279 |
| 5,908,241 | A | * | 6/1999 | Bliss et al. | 366/129 |

FOREIGN PATENT DOCUMENTS

| | | |
|---|---|---|
| DE | 604 851 | 10/1934 |
| DE | 1 138 378 | 10/1962 |

* cited by examiner

*Primary Examiner*—David L. Sorkin
(74) *Attorney, Agent, or Firm*—Gudrun E. Huckett

(57) ABSTRACT

A device for mixing a flowable or pourable medium has a container for receiving the medium and a rotatable shaft having radially projecting support arms and rotatable in a direction of rotation. Mixing elements are connected to the radially projecting support arms. The mixing elements are tubular and formed as coil-shaped spirals conically shaped at least across a partial length of the coil-shaped spirals. The coil-shaped spirals have a first end face and a second end face. The first end face points in the direction of rotation and has a cross-section greater than the cross-section of the second end face. The coil-shaped spirals have a central axis having a slant angle relative to a plane of rotation of the two mixing elements. The support arms and the coil-shaped spirals connected to the support arms, respectively, are formed of a single wire as a monolithic part, respectively.

5 Claims, 3 Drawing Sheets

DEVICE FOR MIXING A FLOWABLE OR POURABLE MEDIUM, ESPECIALLY A HIGHLY VISCOUS MEDIUM

BACKGROUND OF THE INVENTION

The invention relates to a device for mixing a flowable or pourable medium, in particular, a viscous medium. The device comprises a container receiving the medium as well as at least two mixing elements arranged on a rotatable shaft on substantially radially projecting support arms, wherein the mixing elements are tubular with open end faces and are conically shaped at least across an area of partial length, wherein the end face pointing in the direction of rotation has the greater cross-section and wherein the central axis has a slant angle relative to the plane of rotation.

The mixing device according to the invention is suitable for low viscosity to high viscosity fluids. The special field of application are fluids of very high viscosity. Moreover, the mixing device according to the invention is suitable for pourable solids.

The mixing device of the aforementioned kind is known from DE 39 01 894 C2. This mixing device particularly for high viscosity media has a container for receiving the medium, and a rotatable shaft is vertically arranged in the container. Support arms extend approximately radially away from the lower end of this shaft. Mixing elements are provided at the forward end of these support arms. They are tubular with a closed peripheral wall surface wherein the end faces of the tube are open, respectively. Across an area of partial length, these tubular elements are conically shaped wherein the end face with the larger cross-section points in the direction of rotation. The central axes of the mixing elements are slanted relative to the plane of rotation. The basic principle of this known mixing device is that the medium flows through the mixing elements when the shaft rotates. Because of the slanted position of the mixing elements, the medium contained within the container is subjected to a circular movement.

In particular in the case of media having a very high viscosity, there is the risk in the case of the known mixing devices that a plug will form within the conically shaped mixing elements so that medium can no longer flow through the mixing element.

This massively impairs the success of the mixing process.

SUMMARY OF THE INVENTION

Based on this, it is an object of the invention to further develop the mixing device of the aforementioned kind such that even media having very high viscosity can be mixed without plugs being formed In the mixing elements.

The technical solution is characterized in that the peripheral surface area of the mixing elements has openings.

In comparison to the prior art mixing device of the aforementioned kind, the mixing device according to the invention has a broader spectrum of use with respect to its function. For example, with the mixing device according to the invention, media of very high viscosity can be mixed without there being the risk of plug formation. Accordingly, the field of use of the mixing device according to the invention is particularly in the area of media of higher viscosity. Also, suspensions with very high solid contents as well as pasty media can be processed very well with the mixing device, in particular, in a way that is gentle to the product. In this way, with a very minimal energy expenditure as well as with very short mixing phases, even in geometrically difficult containers, and in a way gentle to the product, very good mixing results can be obtained. The mixing system generates with a minimal startup moment and minimal rotary speed of the mixing elements excellent mixing effects already for laminar flow. This mixing effect is achieved substantially by two flow components: firstly, a differential flow between, on the one hand, the central entry stream as well as the external stream and, on the other hand, the exit stream of the conical displacement member, and, secondly, the radial flow passing through the openings and caused by the banking-up pressure in the displacement cone. Accordingly, as a result of the slant of the mixing elements, the medium in the main stream is conveyed from the central part upwardly and tangentially to the wall of the container. At the same time, because of the banking-up pressure in the conical mixing element, a radial flow results which extends substantially at a right angle to the axis of the displacement member. Accordingly, the mixing system according to the invention differs technically from the conventional mixing systems mainly in having significantly reduced rotary speeds and thus a substantially reduced operating power, while providing a greater mixing efficiency. Because of the hydraulically generated turbulences in different directions, a rotation of the material to be mixed is also prevented, i.e., the taken-up power is used exclusively for generating hydraulic eddies. An energy consumption by flow-disturbing elements does not occur in this connection.

A further embodiment, wherein the openings are arranged with rotational symmetry about the entire circumference as well as over the entire length of the peripheral surface area, has the advantage that because of the rotational symmetry of the openings in the mixing elements the radial flow is uniform over all and thus acts across a wide area.

Since, according to a further embodiment, the openings are slots in the peripheral surface area of the mixing elements, a large radial penetration area is provided. The slots can be, in particular, peripherally extending slots.

A preferred configuration of the mixing elements and thus of the openings suggests that the mixing element has the shape of a coil-shaped spiral. The basic idea resides in that the peripheral surface area is defined by a spiral coil (or coil-shaped spiral). This provides a very open structure, i.e., a spiral structure through which the plug formations can escape substantially radially through the intermediate spaces between the windings of the spiral. In addition to these method-based advantages, this mixing element of a spiral shape can also be produced technically in a very simple way.

The advantage of the further embodiment according to which the thickness of the wire of the spiral matches approximately the spacing between two windings of the spiral resides in that an optimal ratio between the axially passing medium and the radially flowing medium is provided.

The further embodiment according to which the support arm and the spiral form a monolithic part has the advantage that the unit comprised of support arm and mixing element can be produced technically in a very simple way from a single piece, i.e., form a single wire, wherein the thickness of the support arm is identical to the thickness of the windings of the spiral.

The further embodiment according to which the slant angle of the central axis of the mixing elements is 10° to 20° relates to the slant of the mixing elements relative to the rotational plane and provides an optimal circulating mixing flow. This also holds true for the further embodiments according to which:

the ratio of intake cross-section and exit cross-section of the mixing elements is between 1.5 and 3.0;

the mixing elements are arranged in the lower third of the container; and the medium to be mixed passes in substantially laminar flow through the mixing elements.

BRIEF DESCRIPTION OF THE DRAWINGS

One embodiment of the mixing device according to the invention will be explained in the following with the aid of the drawings. It is shown in.

DESCRIPTION OF PREFERRED EMBODIMENTS

The mixing device has a cylindrical container 1. From above, a shaft 2 is immersed into the container 1. It has at its upper end a coupling 3 which allows connection of the shaft 2 to a drive motor, not illustrated. In the illustrated embodiment, the shaft 2 is vertically arranged. However, it is also conceivable to position the shaft 2 at a slant.

Figure 3:
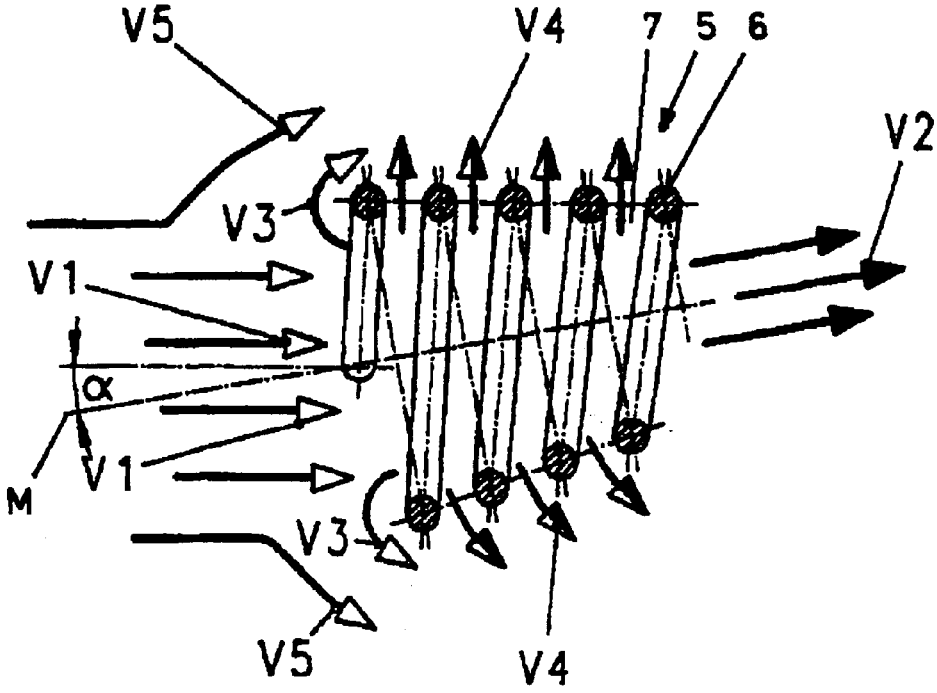
FIG. 3 a longitudinal section of a mixing element in the medium to be mixed at minimal start-up torque with laminar flow.

At the lower end of the shaft 2, four wire-shaped support arms 4 project radially. A mixing element 5 is arranged at the forward end of each one of the support arms 4, respectively. The mixing elements 5 are formed by a coil-shaped spiral 6. This coil-shaped spiral 6 forms the peripheral surface area of a truncated cone. The windings of the spiral 6 define openings 7 therebetween. The two end faces of the cone are open, respectively. As illustrated in FIG. 3, the central axis M of the spiral 6 is positioned at a slant angle $\alpha$ relative to the rotational plane of the mixing elements 5. The support arm 4 and the spiral 6 of the mixing elements 5 are formed as a monolithic part, respectively. Moreover, the spacings of the mixing elements 5 relative to the shaft 2 are identical, respectively, i.e., the four support arm/mixing element combinations are identical, respectively.

The function of the mixing device is as follows.

By rotating the shaft 2, the mixing elements 5 are rotated by means of the support arms 4. The end face with the greater cross-section points in the direction of rotation.

Figure 4:
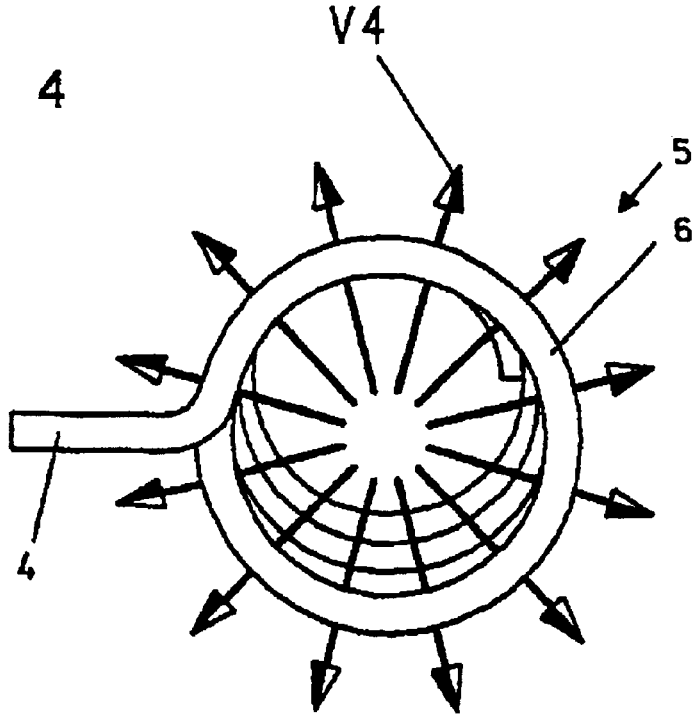
FIG. 4 an end view of the mixing element in FIG. 3.

During this rotary movement of the mixing elements 5, different flow portions result, as illustrated in FIGS. 3 and 4. The central flow V1 penetrates with laminar flow the cone of the spiral 6 of the mixing element 5. The further flow part V3 is deflected outwardly by the end face of the spiral 6. The flow part V5 in the external area is guided externally about the spiral 6.

The mixing effect is caused substantially by two flow components which are formed by the aforementioned flow parts. Firstly, a differential flow is generated between the flow parts V1, V3, V5 and the flow part V2 in the exit stream. The second flow component is the radial flow V4 created in that the medium is deflected by the banking-up pressure present within the spiral 6 to the exterior through the openings 7 between the windings of the spiral.

Figure 1:
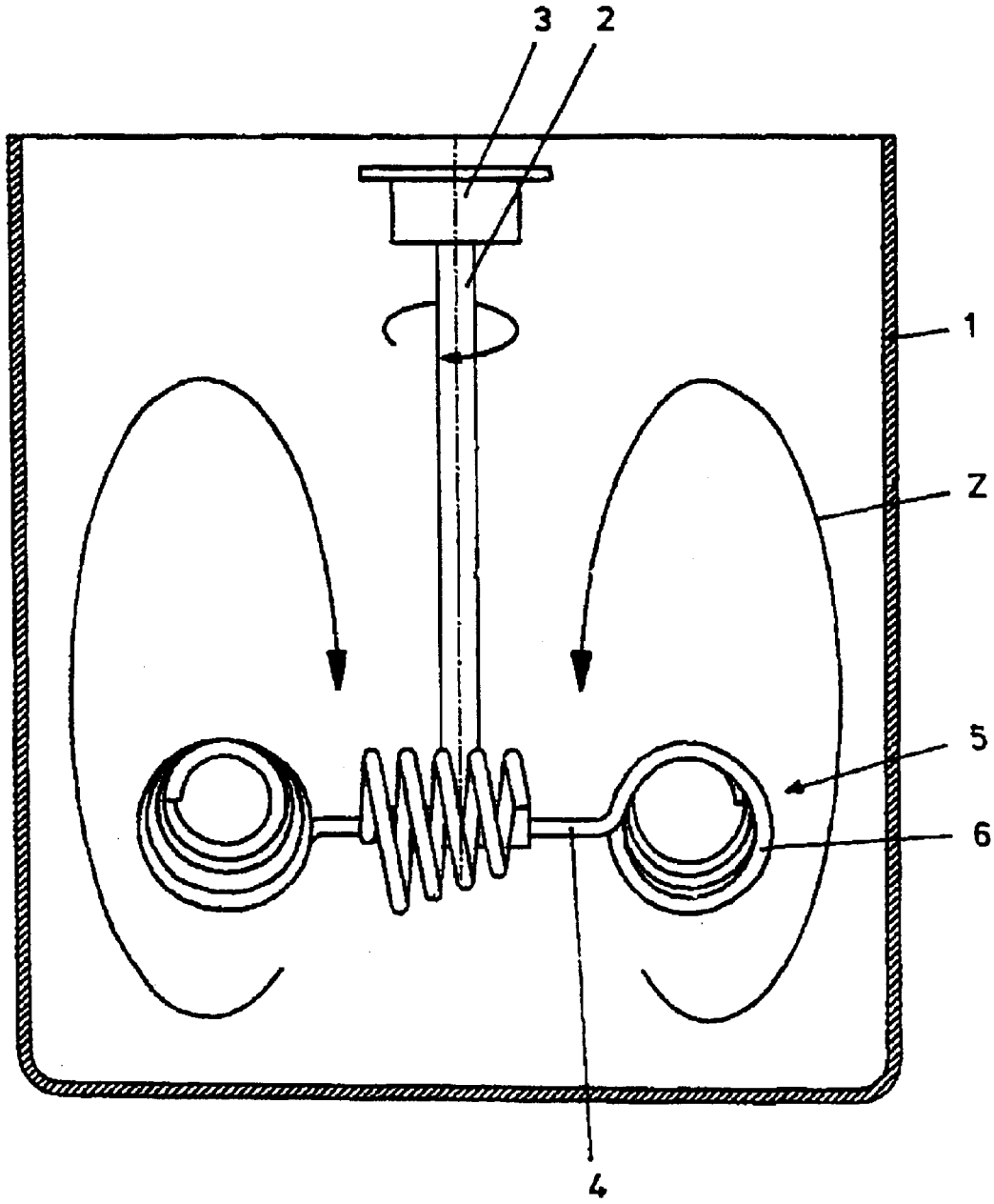
FIG. 1 a schematic illustration of the mixing device with flow pattern.
Figure 2:
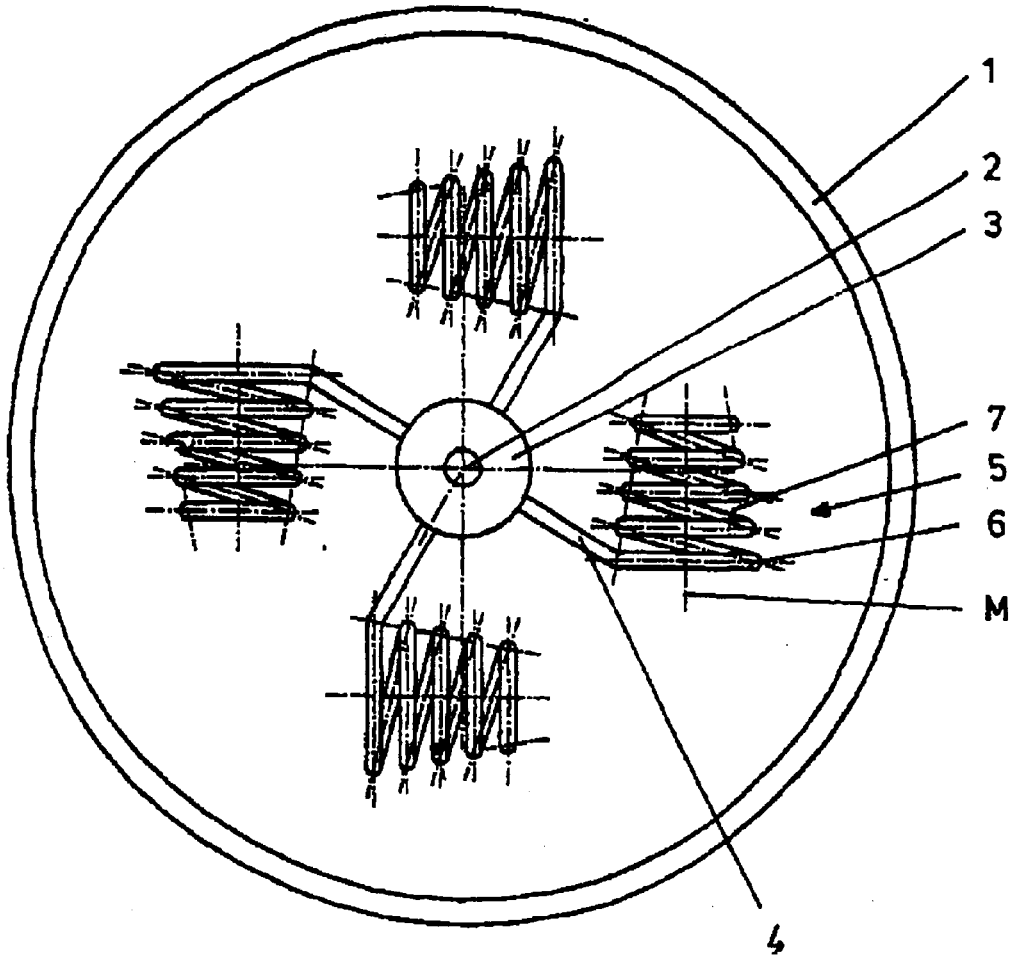
FIG. 2 a plan view onto the mixing device of FIG. 1.

As illustrated in FIG. 1, the slant of the mixing elements 5 causes a continuous closed circular flow Z which in the vicinity of the container wall flows upwardly and in the central part of the container 1 flows downwardly coaxially to the shaft 2 where it passes through the intermediate spaces between the support arms 4. The intensity depends on the magnitude of the slant angle $\alpha$.

LIST OF REFERENCE SIGNS

1 container
2 shaft
3 coupling
4 support arm
5 mixing element
6 spiral
7 opening
$\alpha$ slant angle
M central axis
V1–V5 flow
Z circular flow

What is claimed is:

1. A device for mixing a flowable or pourable medium, the device comprising a container (1) receiving the medium;

a rotatable shaft (2) having substantially radially projecting support arms (4) and rotatable in a direction of rotation;

at least two mixing elements (5) connected to the substantially radially projecting support arms (4);

wherein the at least two mixing elements (5) are tubular and formed as coil-shaped spirals (6) conically shaped at least across a partial length of the coil-shaped spirals (6), respectively;

wherein the coil-shaped spirals (6) have a first end face and a second end face, respectively;

wherein the first end faces pointing in the direction of rotation have a cross-section greater than a cross-section of the second end faces;

wherein the coil-shaped spirals (6) have a central axis (M), respectively, having a slant angle ($\alpha$) relative to a plane of rotation of the at least two mixing elements (5);

wherein the support arms (4) and the coil-shaped spirals (6) connected to the support arms (4), respectively, are formed of a single wire as a monolithic part, respectively.

2. The device according to claim 1, wherein the wire has a thickness matching approximately a spacing between neighboring windings of the coil-shaped spirals (6).

3. The device according to claim 1, wherein the slant angle ($\alpha$) of the central axis (M) is 10° to 20°.

4. The device according to claim 1, wherein a ratio of an intake cross-section and an exit cross-section of the mixing elements (5) is between 1.5 and 3.0.

5. The device according to claim 1, wherein the mixing elements (5) are arranged in the lower third of the container (1).

* * * * *